US005243361A

United States Patent [19]

Kishimoto et al.

[11] Patent Number: 5,243,361

[45] Date of Patent: Sep. 7, 1993

[54] LINE-TYPE THERMAL PRINTING HEAD

[75] Inventors: Tokihiko Kishimoto; Takaya Nagahata, both of Kyoto, Japan

[73] Assignee: Rohm Co., Ltd., Kyoto, Japan

[21] Appl. No.: 939,924

[22] Filed: Sep. 2, 1992

[30] Foreign Application Priority Data

Sep. 17, 1991 [JP] Japan ..... 3-74451[U]

[51] Int. Cl.[5] ..... B41J 2/325

[52] U.S. Cl. ..... 346/76 PH

[58] Field of Search ..... 346/76 PH

[56] References Cited

U.S. PATENT DOCUMENTS 4,728,967 3/1988 Tomita et al. ..... 346/76 PH 4,963,886 10/1990 Fukuda et al. ..... 346/76 PH

*Primary Examiner*—Benjamin R. Fuller

*Assistant Examiner*—Huan Tran

*Attorney, Agent, or Firm*—William H. Eilberg

[57] ABSTRACT

A line-type thermal printing head comprises an elongate heat sink plate, an elongate head substrate mounted on the heat sink plate and carrying connection terminals arranged generally in a longitudinally central portion of the head substrate, a connector board overlapped on the central portion of the substrate board and having connection terminals corresponding to the connection terminals of the substrate board, and an elongate cover member overlapped on the connector board and provided with an elastic pressing member. The elastic pressing member comprises a diametrically larger portion for contact with the connector board and a pair of diametrically smaller portions located on both sides of the diametrically larger portion clear of the connector board.

4 Claims, 5 Drawing Sheets

LINE-TYPE THERMAL PRINTING HEAD

BACKGROUND OF THE INVENTION

1. Field of the Invention

This invention relates to a thermal printing head. More specifically, the present invention relates to a line-type thermal printing head in which connection terminals used for electrical connection to an external control circuit are arranged locally only in a limited central portion of the head.

2. Description of the Prior Art

As is well known, line-type thermal printing heads are widely used in facsimile machines to print transmitted information on thermosensitive paper. The line-type thermal printing head is also used in printers wherein the ink of a transfer ink ribbon or film is thermally caused to be transferred onto printing paper.

An example of prior line-type thermal printing head is disclosed for example in U.S. Pat. No. 4,963,886 to Fukuda et al. For the convenience of explanation, reference is now made to FIGS. 6–9 of the accompanying drawings which show a line-type thermal printing heat similar to the one disclosed in the above U.S. patent.

As shown in FIGS. 6–9, the prior art line-type thermal printing head includes an elongate metallic heat sink plate 1'' and an elongate insulating head substrate 2'' attached onto the heat sink plate. The heat sink plate 1'' and the head substrate 2'' have an equal length LO'' which is an overall length of the thermal printing head.

The head substrate 2'' has an upper surface formed with a heating resistor line 3'' extending longitudinally of the substrate adjacent to one longitudinal edge thereof for linear contact with a platen 19'', and an array of drive IC's 4'' also extending longitudinally of the substrate. The upper surface of the head substrate 2'' is further formed with a plurality of connection terminals 5'' arranged adjacent to the other longitudinal edge of the substrate within a limited central portion thereof.

The thermal head further comprises a connector board 6'' which includes a flexible film 7'' and a reinforcing plate 8''. The connector board 6'' has a length L1'' which is sufficiently smaller than the length LO'' of the head substrate 2'' because the connection terminals 5'' of the head substrate 2'' are arranged locally only within the limited central portion.

The flexible film 7'' of the connector board 6'' has a marginal portion 7a'' projecting beyond the reinforcing plate 8''. The underside of the marginal portion 7a'' is formed with a plurality of connection terminals 9'' corresponding to the connection terminals 5'' of the head substrate 2''.

The underside of the reinforcing plate 8'' carries a connector 10'' for connection to an external control circuit (not shown). The connector 10'' is electrically connected to the connection terminals 9'' through a conductor pattern (not shown) formed on the connector board 6''.

The connector board 6'' is held in place on the heat sink plate 1'' by means of an elongate cover member 11'' which is substantially equal in length to the head substrate 2''. The cover member 11'' covers the array of drive IC's 4'' for protection, as shown in FIG. 7.

The cover member 11'' is provided with non-threaded central holes 12'' and non-threaded end holes 15'', whereas the heat sink plate 1'' is provided with threaded central holes 13'' and threaded end holes 16''. Central and end screws 14'', 17'' are inserted through the respective non-threaded holes 12'', 15'' into engagement with the respective threaded holes 13'', 16'', thereby fixing the cover member 11'' together with the connector board 6'' relative to the heat sink plate 1''.

The underside of the cover member 11'' is formed with a longitudinal groove 11a'' at a position corresponding to the projecting marginal portion 7a'' of the flexible film 7'' for receiving a rod-like pressing rubber member 18'' of a constant diameter. Thus, when the cover member 11'' is fixed onto the heat sink plate 1'', the pressing member 18'' presses the marginal portion 7a'' to bring the connection terminals 9'' of the connector board 6'' into intimate electrical contact with the connection terminals of the head substrate 2''.

With the arrangement described above, since the connection terminals 5'' of the head substrate 2'' are arranged locally only in the limited central portion of the substrate, there are at least three advantages, as described in U.S. Pat. No. 4,963,886. First, the length of the connector board 6'' can be correspondingly reduced to realize material saving. Secondly, only the two central screws 14'' need be tightened with a strictly controlled force because electrical contact between the head substrate 2'' and the connector board 6'' is needed only in the central portion, so that an assembling operation for the cover member 11'' can be facilitated. In the third place, the thermal head can be effectively prevented from thermally bending during operation, thereby avoiding deterioration of the printing quality. The operating mechanism for the prevention of thermal bending is clearly described in U.S. Pat. No. 4,963,886 and therefore not described here.

However, since the pressing rubber member 18'' for the prior art thermal head has a constant diameter, the cover member 11'' will have a tendency to bulge upward at the portions between the central screws 14'' and the end screws 17''. More specifically, when the respective screws 14'', 17'' are tightened up, the rubber member 18'' is elastically compressed more at the positions of these screws than at the portions between the respective screws. Since the distance between the two central screws 14'' is relatively small, upward bulging of the cover member 11'' is less likely to occur at the central portion of the cover member between these two central screws. On the other hand, since the distance between each central screw 14'' and each end screw 17'' is much larger, the cover member 11'' is likely to bulge upward at the portion between the central screw 14'' and the end screw 17'' due to the reaction force of the rubber member 18'' and the inevitable elasticity of the cover member 11'', as indicated by phantom lines in FIG. 8.

Once the cover member 11'' bulges or bends upward, it may come into interfering contact with the platen 19'', consequently hindering proper printing or paper feeding. Further, such an interfering contact may damage the platen 19'' due to abrasion.

SUMMARY OF THE INVENTION

It is, therefore, an object of the present invention to provide a line-type thermal printing head which can solve the problems of the prior art described above.

According to the present invention, there is provided a line-type thermal printing head comprising: an elongate heat sink plate; an elongate head substrate mounted on the heat sink plate, the head substrate carrying a heating resistor line and drive elements for the resistor line, the head substrate further carrying a plurality of connection terminals arranged generally in a longitudinally central portion of the head substrate, the central portion being sufficiently shorter than the head substrate; a connector board overlapped on the central portion of the substrate board and having a plurality of connection terminals in corresponding relation to the connection terminals of the substrate board, the connector board being sufficiently shorter than the head substrate; and an elongate cover member overlapped on the connector board, the cover member being sufficiently longer than the connector board, the cover member being formed with a longitudinal groove for receiving an elastic pressing means which presses the connector board to bring the connection terminals thereof into contact with the connection terminals of the substrate board; wherein the elastic pressing means comprises a diametrically larger portion for contact with the connector board and a pair of diametrically smaller portions located on both sides of the diametrically larger portion clear of the connector board.

Other objects, features and advantages of the present invention will become apparent from the following detailed description of the preferred embodiments given with reference to the accompanying drawings.

DETAILED DESCRIPTION OF THE PREFERRED EMBODIMENT

Figure 1:
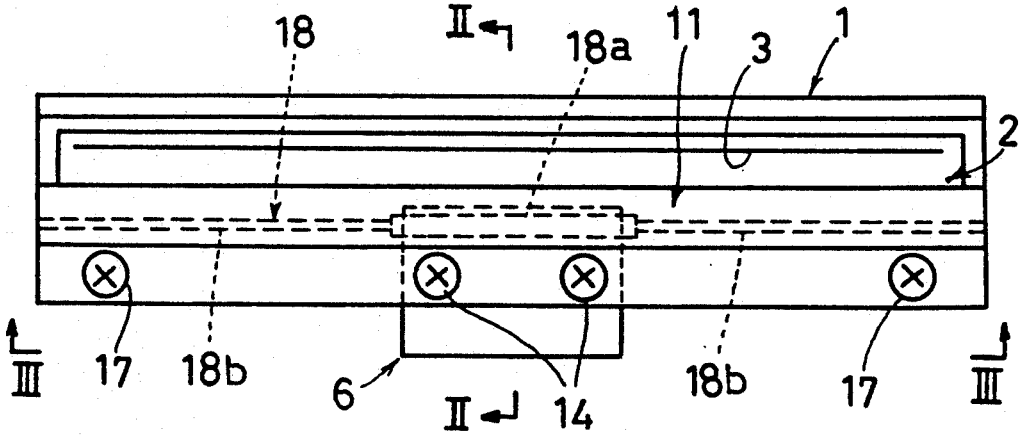
FIG. 1 is a plan view showing a line-type thermal printing head embodying the present invention.

Referring first to FIGS. 1-4 of the accompanying drawings, a line-type thermal printing head according to the present invention includes an elongate heat sink plate 1 and an elongate head substrate 2 attached onto the heat sink plate. The heat sink plate 1 is made of aluminum for example. The head substrate 2 is made of an insulating material such as ceramic. The heat sink plate 1 and the head substrate 2 have an equal length L0 which is an overall length of the thermal printing head.

The head substrate 2 has an upper surface formed with a heating resistor line 3 extending longitudinally of the substrate adjacent to one longitudinal edge thereof for coming into linear contact with a platen 19, and an array of drive IC's 4 also extending longitudinally of the substrate. The upper surface of the head substrate 2 is further formed with a plurality of connection terminals 5 (see FIG. 4) arranged adjacent to the other longitudinal edge of the substrate within a limited central portion thereof.

The thermal head further comprises a connector board 6 which includes a flexible film 7 and a reinforcing plate 8. The connector board 6 has a length L1 which is sufficiently smaller than the length L0 of the head substrate 2 because the connection terminals 5 of the head substrate 2 are arranged locally only within the limited central portion.

The flexible film 7 of the connector board 6 has a marginal portion 7*a* projecting beyond the reinforcing plate 8. The underside of the marginal portion 7*a* is formed with a plurality of connection terminals 9 in corresponding relation to the connection terminals 5 of the head substrate 2.

The underside of the reinforcing plate 8 carries a connector 10 (see FIG. 2) for connection to an external control circuit (not shown). The connector 10 is electrically connected to the connection terminals 9 through a conductor pattern (not shown) formed on the connector board 6.

Figure 2:
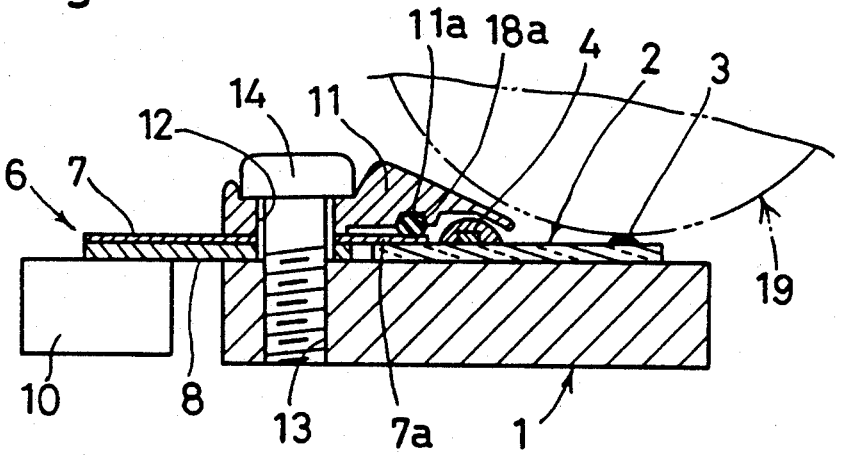
FIG. 2 is a sectional view taken along lines II—II in FIG. 1.
Figure 3:
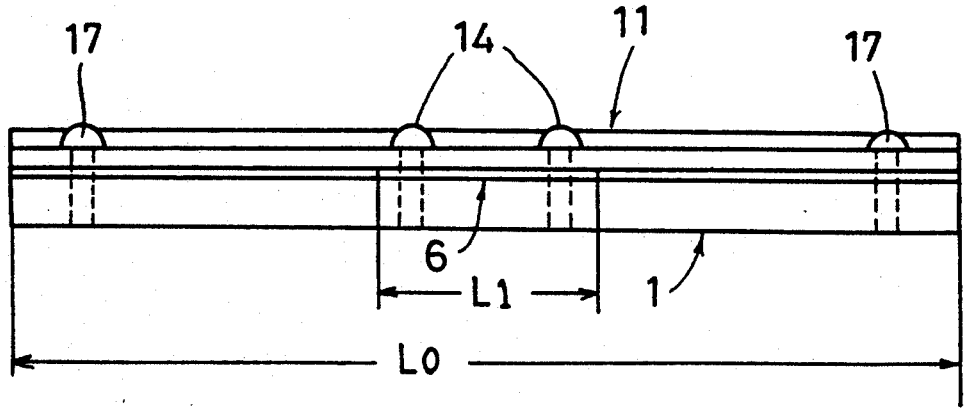
FIG. 3 is a view of the same head as seen in the direction of arrows III—III in FIG. 1.
Figure 4:
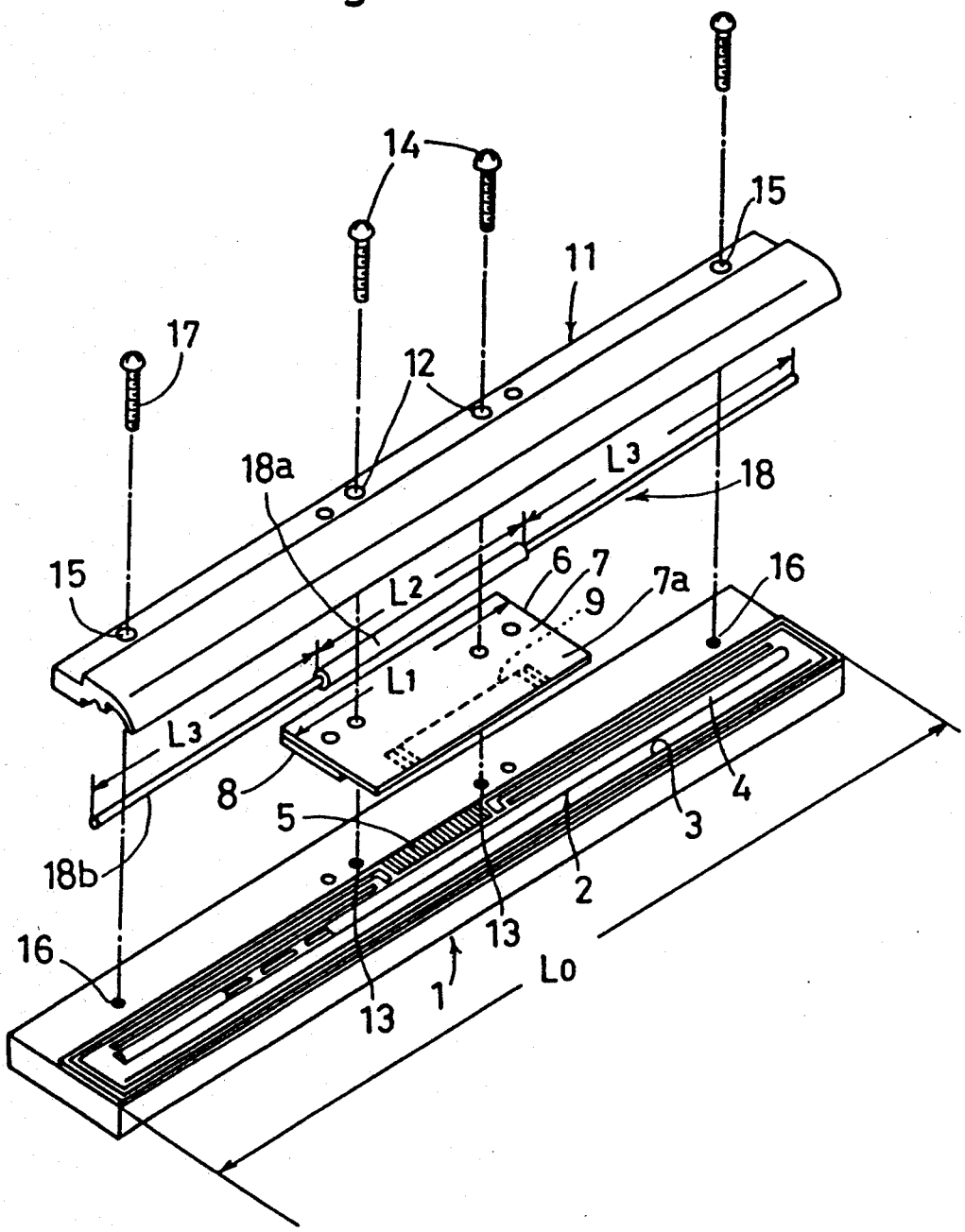
FIG. 4 is a perspective view showing the same head in an exploded state.

The connector board 6 is held in place on the heat sink plate 1 by means of an elongate cover member 11 which is substantially equal in length to the head substrate 2. The cover member 11, which may be made of aluminum for example, covers the array of drive IC's 4 for protection, as best shown in FIG. 2.

The cover member 11 is provided with non-threaded holes 12, 15, whereas the heat sink plate 1 is provided with threaded holes 13, 16. Screws 14, 17 are inserted through the respective non-threaded holes 12, 15 into engagement with the respective threaded holes 13, 16, thereby fixing the cover member 11 together with the connector board 6 relative to the heat sink plate 1.

The underside of the cover member 11 is formed with a longitudinal groove 11*a* at a position corresponding to the projecting marginal portion 7*a* of the flexible film 7 for receiving a rod-like elastic pressing member 18 which may be made of rubber for example. Thus, when the cover member 11 is fixed onto the heat sink plate 1, the pressing member 18 presses the marginal portion 7*a* of the flexible film 7 to bring the connection terminals 9 of the connector board 6 into intimate electrical contact with the connection terminals of the head substrate 2.

According to the embodiment shown in FIGS. 1 to 4, the elastic pressing member 18 includes a diametrically larger central portion 18*a* corresponding in position to the projecting marginal portion 7*a* of the flexible film 7, and a pair of diametrically smaller end portions 18*b* integral with the central portion 18*a* on both sides thereof. The central portion 18*a* has a length L2 which is substantially equal to the length L1 of the connector board 6, whereas each of the end portions 18*b* has a length L3 which is equal to half of (L0-L2).

With the arrangement described above, when the cover member 11 is fixed to the heat sink plate 1 by tightening the respective screws 14, 17, the diametrically larger central portion 18*a* of the elastic pressing member 18 is deformed to a greater degree than the diametrically smaller end portions 18*b*. Thus, the projecting marginal portion 7*a* of the flexible film 7 is pressed against the head substrate 2 with a large force, thereby ensuring reliable electrical contact between the connection terminals 9 of the connector board 6 and the connection terminals 5 of the head substrate 2.

On the other hand, since the elastic deformation of the diametrically smaller end portions 18*b* is kept to a lower degree, the cover member 11 is effectively prevented from bulging upward at portions corresponding to the end portions 18*b* of the elastic pressing member 18 due to a reduction in the reaction force of the end portions 18*b*. Thus, it is possible to eliminate or reduce the printing quality deterioration which would result from bulging deformation of the cover member 11.

Figure 5:
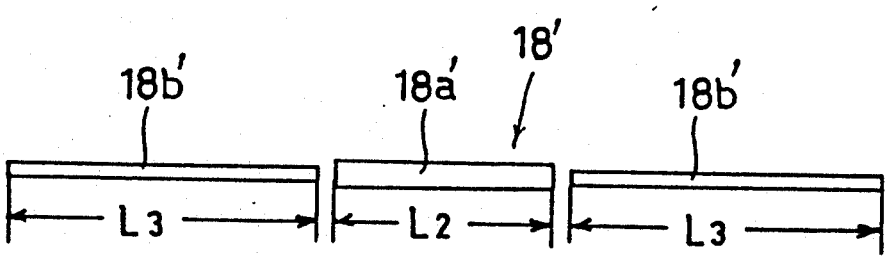
FIG. 5 is a view showing a modified elastic pressing member.
Figure 6:
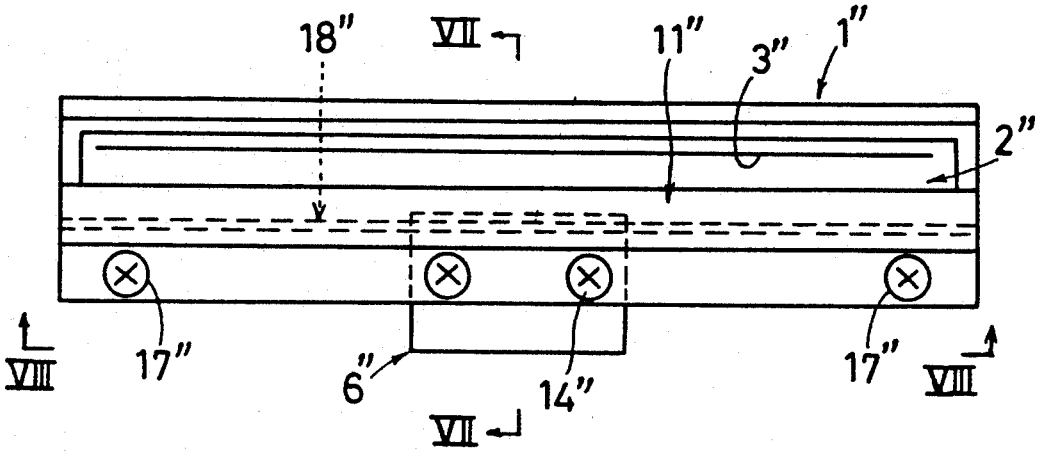
Fig. 6 Prior Art
FIG. 6 is a plan view showing a prior art line-type thermal printing head.
Figure 7:
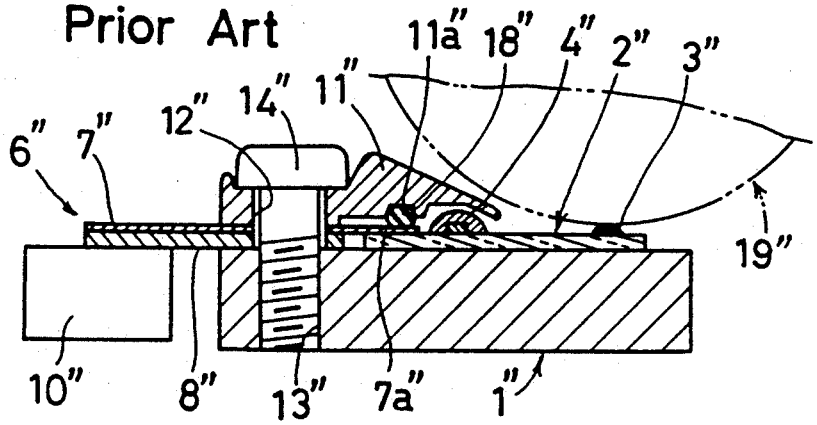
Fig. 7 Prior Art
FIG. 7 is a sectional view taken along lines VII—VII in FIG. 6.
Figure 8:
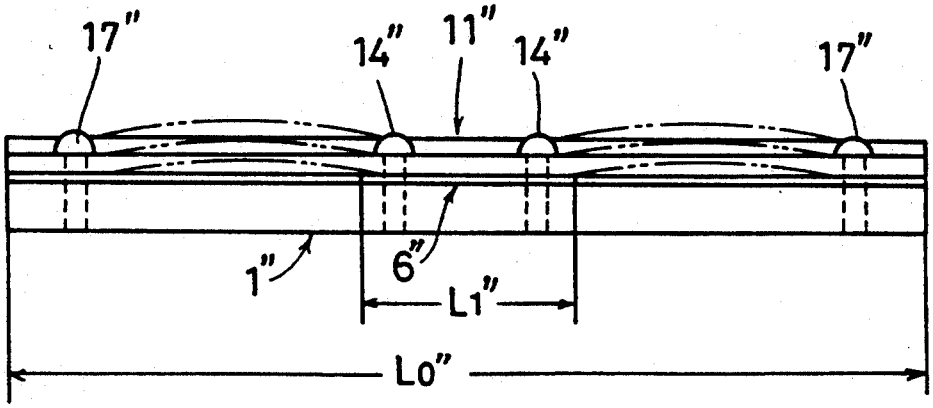
Fig. 8 Prior Art
FIG. 8 is a view of the prior art head as seen in the direction of arrows VIII—VIII in FIG. 6.
Figure 9:
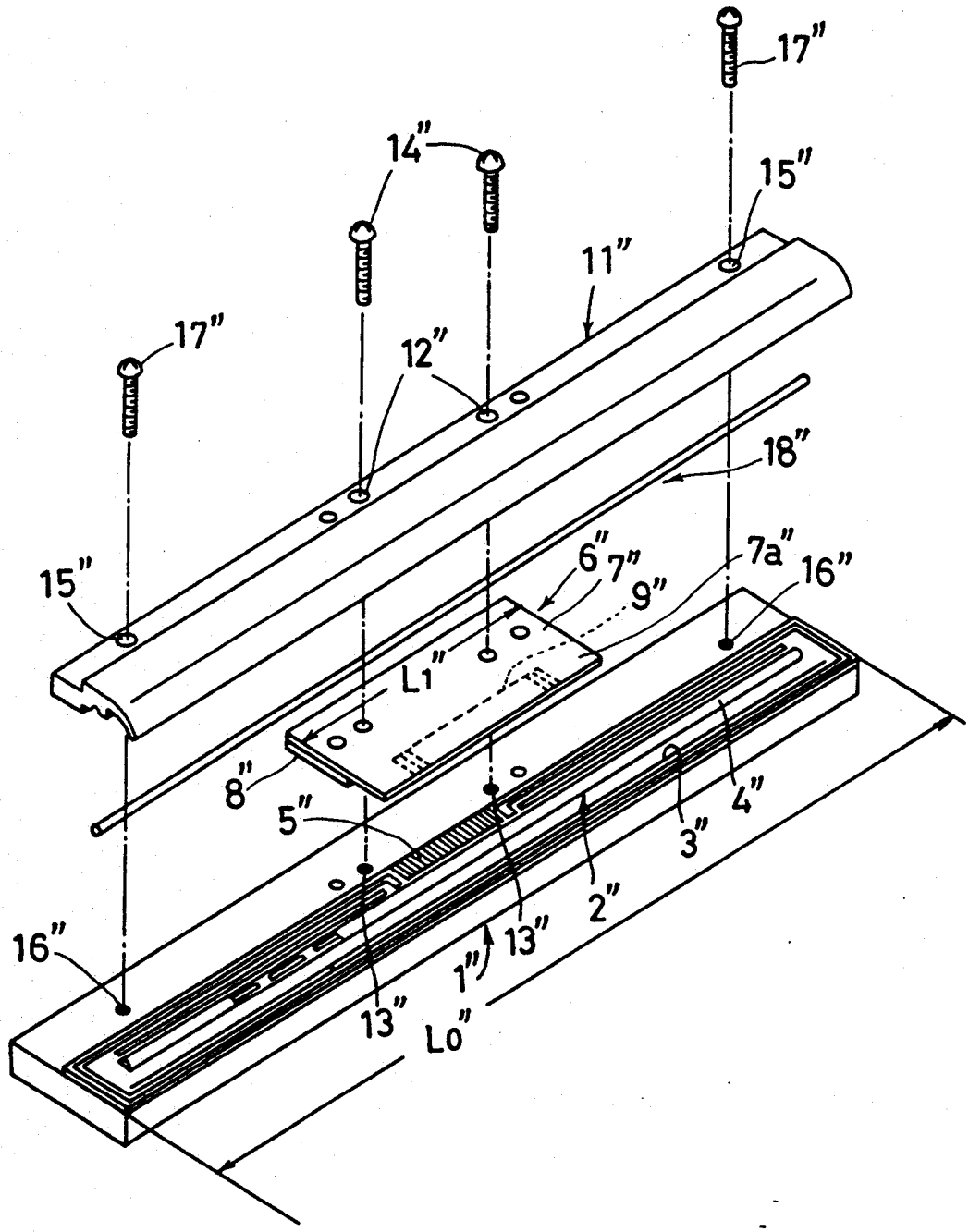
Fig. 9 Prior Art
FIG. 9 is a perspective view showing the prior art head in an exploded state.

FIG. 5 shows a modified elastic pressing member 18' which comprises a diametrically larger central portion 18*a'* and a pair of diametrically smaller end portions 18*b'* separate from the central portion 18*a'*. This separate type pressing member is preferred in that it can be manufactured more easily than the integral type pressing member of the foregoing embodiment although the integral type pressing member can be assembled more easily than the separate type pressing member.

The present invention being thus described, it is obvious that the same may be varied in many ways. Such variations are not to be regarded as a departure from the spirit and scope of the the invention, and all such modifications as would be obvious to those skilled in the art are intended to be included within the scope of he following claims.

I claim:

1. A line-type thermal printing head comprising: an elongate heat sink plate;

an elongate head substrate mounted on the heat sink plate, the head substrate carrying a heating resistor line and drive elements for the resistor line, the head substrate further carrying a plurality of connection terminals arranged generally in a longitudinally central portion of the head substrate, the central portion being sufficiently shorter than the head substrate;

a connector board overlapped on the central portion of the head substrate and having a plurality of connection terminals in corresponding relation to the connection terminals of the head substrate, the connector board being sufficiently shorter than the head substrate; and an elongate cover member overlapped on the connector board, the cover member being sufficiently longer than the connector board, the cover member being formed with a longitudinal groove for receiving an elastic pressing means which presses the connector board to bring the connection terminals thereof into contact with the connection terminals of the head substrate;

wherein the elastic pressing means comprises a diametrically constant central portion for contact with the connector board and a pair of diametrically constant end portions located on both sides of the central portion of the elastic pressing means clear of the connector board, the diameter of the central portion of the pressing means being abruptly larger than that of the end portions.

2. The thermal printing head according to claim 1, wherein the diametrically larger portion of the elastic pressing means is integral with the diametrically smaller portions.

3. The thermal printing head according to claim 1, wherein the diametrically larger portion of the elastic pressing means is separate from the diametrically smaller portions.

4. The thermal printing head according to claim 1, wherein the elastic pressing means is made of rubber.

* * * * *